US010793786B2

(12) United States Patent
Gupta

(10) Patent No.: US 10,793,786 B2
(45) **Date of Patent: *Oct. 6, 2020**

(54) BITUMEN PROCESSING AND TRANSPORT

(71) Applicant: Cenovus Energy Inc., Calgary, Alberta (CA)

(72) Inventor: Subodh Gupta, Calgary (CA)

(73) Assignee: Cenovus Energy Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/219,436

(22) Filed: Dec. 13, 2018

(65) Prior Publication Data

US 2019/0119582 A1 Apr. 25, 2019

Related U.S. Application Data

(62) Division of application No. 15/199,122, filed on Jun. 30, 2016, now Pat. No. 10,190,062.
(Continued)

(51) Int. Cl.
*C10G 55/04* (2006.01)
*C10C 3/14* (2006.01)
(Continued)

(52) U.S. Cl.
CPC ..... *C10G 55/04* (2013.01); *C10C 3/14* (2013.01); *C10G 21/003* (2013.01); *F17D 1/088* (2013.01)

(58) Field of Classification Search
CPC ..... C10G 55/04; C10G 21/003; C10C 3/14; F17D 1/088
See application file for complete search history.

(56) References Cited

U.S. PATENT DOCUMENTS 3,026,568 A 3/1962 Moar
3,207,824 A 9/1965 Wurster et al.
(Continued)

FOREIGN PATENT DOCUMENTS

CA 2302429 4/1999
CA 2789921 8/2011
WO WO 2005/081775 9/2005

OTHER PUBLICATIONS

Saniere, A., et al. Pipeline Transportation of Heavy Oils, A Strategic, Economic and Technological Challenge. Oil & Gas Science & Technology—Rev. IFP, vol. 59 (2004), No. 5, pp. 455-466.
(Continued)

*Primary Examiner* — Pamela H Weiss
(74) *Attorney, Agent, or Firm* — Knobbe, Martens, Olson & Bear LLP

(57) ABSTRACT

Methods for preparing, converting, and/or transporting bitumen are provided. Asphaltene prills, prilling processes, and converted bitumen suitable for transport are disclosed. One method for preparing bitumen for transport comprises: separating asphaltene from the bitumen to generate a deasphalted oil and asphaltene; separating the asphaltene into a first asphaltene fraction and a second asphaltene fraction, the first asphaltene fraction being less soluble in deasphalted oil and the second asphaltene fraction being more soluble in deasphalted oil; and forming an asphaltene prill comprising an inner core comprising the second asphaltene fraction and an outer layer comprising the first asphaltene fraction. Asphaltene prills disclosed herein may comprise an inner core comprising an asphaltene fraction having more solubility in deasphalted oil, and an outer layer comprising an asphaltene fraction having less solubility in deasphalted oil. Methods for the transport of bitumen via a pipeline are disclosed.

8 Claims, 4 Drawing Sheets

Related U.S. Application Data

(60) Provisional application No. 62/188,021, filed on Jul. 2, 2015.

(51) Int. Cl.
*F17D 1/08* (2006.01)
*C10G 21/00* (2006.01)

(56) References Cited

U.S. PATENT DOCUMENTS

| | | | |
|---|---|---|---|
| 3,900,041 | A | 8/1975 | Kersch et al. |
| 4,082,823 | A | 4/1978 | Augustine et al. |
| 4,769,288 | A | 9/1988 | Saylak |
| 5,637,350 | A | 6/1997 | Ross |
| 6,331,245 | B1 | 12/2001 | Moretta et al. |
| 6,357,526 | B1 | 3/2002 | Abdel-Halim et al. |
| 6,361,682 | B1 | 3/2002 | Moretta et al. |
| 6,499,979 | B2 | 12/2002 | Northup, Jr. et al. |
| 7,968,020 | B2 | 6/2011 | Behelfer et al. |
| 8,404,164 | B2 | 3/2013 | Stockwell |
| 10,106,745 | B2 * | 10/2018 | Gupta ..... B01J 2/30 |
| 10,190,062 | B2 * | 1/2019 | Gupta ..... C10G 21/003 |
| 2011/0185631 | A1 | 8/2011 | Subramanian et al. |
| 2012/0090220 | A1 | 4/2012 | Dieckmann et al. |
| 2012/0151834 | A1 | 6/2012 | Duyvesteyn et al. |
| 2012/0312723 | A1 | 12/2012 | Duma |
| 2013/0036714 | A1 | 2/2013 | Bolton et al. |

OTHER PUBLICATIONS

Sandvik, Company publication, Sandvik capabilities in the petrochemical industry; Jun. 2004.

* cited by examiner

201

BITUMEN PROCESSING AND TRANSPORT

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application is a divisional of U.S. patent application Ser. No. 15/199,122 filed on Jun. 30, 2016, which claims the benefit of U.S. Provisional Patent Application Ser. No. 62/188,021, filed Feb. 7, 2015, the contents of all of which are incorporated herein by reference in their entirety.

FIELD OF INVENTION

Some embodiments described herein relate generally to methods for preparing, converting, and/or transporting bitumen. Some embodiments also relate to asphaltene prills, prilling processes, and converted bitumen suitable for transport. More specifically, some embodiments relate to methods for processing bitumen and transporting bitumen in a pipeline.

BACKGROUND

Bitumen is a highly viscous form of petroleum which is widely produced in the oil and gas industry. Large natural deposits of bitumen may be found, for example, in Canadian oil sands. The high viscosity of bitumen is at least partly due to the asphaltene content of bitumen, which can complicate the recovery and transportation of bitumen to refineries. Increasing energy demands worldwide mean that accessible heavy or viscous oils, such as bitumen, will become increasingly important sources of energy moving forward, despite the challenges associated with recovery and transportation.

Currently, it is common to transport bitumen from recovery sites to refineries via railway. In some examples, asphaltenes may be removed from the bitumen thereby reducing the viscosity of the bitumen. The asphaltenes may then be transported via railway, while the remainder of the recovered bitumen is transported via pipeline. In either case, the costs associated with railway transport can be substantial.

Recovered bitumen may alternatively be transported via pipelines. However, the high viscosity of bitumen presents challenges for pipeline transportation infrastructure. Traditional approaches to the pipeline transport of bitumen include heating, dilution, oil-in-water systems, core annular flow, and partial upgrading (Saniere et al. (2004) Pipeline Transportation of Heavy Oils, a Strategic, Economic, and Technological Challenge; *Oil & Gas Science and Technology,* 59(5), 455-466). One of the main approaches for bitumen transport via pipeline is dilution, which involves diluting bitumen with a diluent such as "Pentane Plus" in order to generate a blend with decreased viscosity allowing for transport via pipeline. The diluent may be recovered and recycled, or the diluent/bitumen blend may be sold or used directly. In either case, large amounts of diluent may be required, which can incur substantial added expense.

Alternative bitumen processing and transportation methods are being developed. One example is provided in WO2012/050649, which describes forming coated asphaltene particles, slurrying the coated asphaltene particles with the carrier, and transporting the slurry to a treatment facility. However, cost-effective generation of coated asphaltene particles, which must be sufficiently stable in the carrier, remains a significant challenge. The difficulty of bitumen transport in pipelines remains substantial due to the asphaltene component of bitumen, and improved methods for asphaltene processing and transport are desirable. It would therefore be desirable to provide methods of pipeline-based bitumen transport which do not rely on the use of large diluent volumes. Methods for transporting bitumen via pipeline are highly sought-after in the oil and gas industry.

SUMMARY OF INVENTION

In one embodiment, the present invention provides for a method for preparing bitumen for transport, the method comprising:

- separating asphaltene from the bitumen to generate a deasphalted oil and asphaltene;
- separating the asphaltene into a first asphaltene fraction and a second asphaltene fraction, the first asphaltene fraction being less soluble in deasphalted oil and the second asphaltene fraction being more soluble in deasphalted oil; and
- forming an asphaltene prill comprising an inner core comprising the second asphaltene fraction and an outer layer comprising the first asphaltene fraction.

In another embodiment of the method or methods outlined above, the method may further comprise a step of:

- adding one or more hollow portions to the asphaltene prill to control the density of the asphaltene prill.

In a further embodiment of the method or methods outlined above, the method may further comprise a step of:

- combining the asphaltene prill with the deasphalted oil to form a slurry suitable for transport in a pipeline.

In yet another embodiment of the method or methods outlined above, one or more additional diluents may be added to the slurry.

In a further embodiment of the method or methods outlined above, the method may further comprise a step of:

- visbreaking the deasphalted oil to reduce the viscosity of the oil.

In another embodiment, the present invention provides for a method for converting bitumen for transport, the method comprising:

- separating asphaltene from the bitumen to generate a deasphalted oil and asphaltene;
- separating the asphaltene into a first asphaltene fraction and a second asphaltene fraction, the first asphaltene fraction being less soluble in deasphalted oil and the second asphaltene fraction being more soluble in deasphalted oil; and
- forming an asphaltene prill comprising an inner core comprising the second asphaltene fraction and an outer layer comprising the first asphaltene fraction.

In another embodiment of the method or methods outlined above, the method may further comprise a step of:

- adding one or more hollow portions to the asphaltene prill to control the density of the asphaltene prill.

In still another embodiment of the method or methods outlined above, the method may further comprise a step of:

- combining the asphaltene prill with the deasphalted oil to form a slurry suitable for transport.

In yet another embodiment of the method or methods outlined above, one or more additional diluents may be added to the slurry.

In still another embodiment of the method or methods outlined above, the method may further comprise a step of:

visbreaking the deasphalted oil to reduce the viscosity of the oil.

In another embodiment, the present invention provides for a converted bitumen comprising:

asphaltene prills, the asphaltene prills comprising an asphaltene inner core comprising an asphaltene fraction that is more soluble in deasphalted oil and an asphaltene outer layer comprising an asphaltene fraction that is less soluble in deasphalted oil; and deasphalted oil.

In another embodiment of a converted bitumen outlined above, the deasphalted oil may be visbroken deasphalted oil.

In another embodiment of a converted bitumen outlined above, the asphaltene prills may further comprise at least one hollow portion.

In another embodiment of a converted bitumen outlined above, the at least one hollow portion may be in the inner core of the asphaltene prills.

In another embodiment of a converted bitumen outlined above, the converted bitumen may further comprise one or more additional diluents.

In another embodiment, the present invention provides for a method of increasing the flowability of a bitumen for facilitating transportation thereof, said method comprising:

separating asphaltene from the bitumen to generate a deasphalted oil and asphaltene;

separating the asphaltene into a first asphaltene fraction and a second asphaltene fraction, the first asphaltene fraction being less soluble in deasphalted oil and the second asphaltene fraction being more soluble in deasphalted oil;

forming an asphaltene prill comprising an inner core comprising the second asphaltene fraction and an outer layer comprising the first asphaltene fraction; and combining the asphaltene prill with the deasphalted oil to form a slurry with increased flowability.

In another embodiment of the method or methods outlined above, the method may further comprise a step of:

adding one or more hollow portions to the prill to modify the density of the asphaltene prill.

In another embodiment of the method or methods outlined above, the one or more hollow portions may be added to the inner core of the asphaltene prill.

In another embodiment of the method or methods outlined above, the method may further comprise a step of:

visbreaking the deasphalted oil to reduce the viscosity of the oil.

In yet another embodiment of the method or methods outlined above, one or more additional diluents may be added to the slurry.

In another embodiment, the present invention provides for a prilling process for generating asphaltene prills from asphaltene, said process comprising:

providing a first, less soluble, asphaltene fraction providing a second, more soluble, asphaltene fraction introducing the second asphaltene fraction into a prilling vessel, forming droplets; and spraying the first asphaltene fraction onto the droplets, thereby coating the droplets with the first asphaltene fraction and generating asphaltene prills.

In another embodiment of a prilling process outlined above, the process may further comprise a step of:

introducing a gas to form one or more hollow portions in the asphaltene prills.

In another embodiment of a prilling process outlined above, the second asphaltene fraction may be in liquid form when introduced into the prilling vessel.

In still another embodiment of a prilling process outlined above, the second asphaltene fraction may be in solid form, and a temperature increase before, during, or after introduction to the prilling vessel may be used to convert the second asphaltene fraction to a liquid form.

In another embodiment of a prilling process outlined above, the first asphaltene fraction may be in liquid form for spraying onto the droplets.

In still another embodiment of a prilling process outlined above, the first asphaltene fraction may be in solid form, and a temperature increase before or during spraying may be used to convert the first asphaltene fraction to a liquid form.

In another embodiment, the present invention provides for an asphaltene prill comprising:

an inner core, the inner core comprising an asphaltene fraction having a first solubility in deasphalted oil; and an outer layer, the outer layer comprising an asphaltene fraction having a second solubility in deasphalted oil, wherein the second solubility is less than the first solubility.

In another embodiment of a asphaltene prill outlined above, the asphaltene prill may further comprise at least one hollow portion.

In another embodiment of a asphaltene prill outlined above, the at least one hollow portion may be in the inner core of the asphaltene prill.

In another embodiment, the present invention provides for a method for transporting a bitumen in a pipeline, the method comprising:

separating asphaltene from the bitumen to generate a deasphalted oil and asphaltene;

separating the asphaltene into a first asphaltene fraction and a second asphaltene fraction, the first asphaltene fraction being less soluble in deasphalted oil and the second asphaltene fraction being more soluble in deasphalted oil;

forming an asphaltene prill comprising an inner core comprising the second asphaltene fraction and an outer layer comprising the first asphaltene fraction;

combining the asphaltene prill with the deasphalted oil to form a slurry having a flowability suitable for transport in a pipeline; and transporting the slurry in a pipeline.

In another embodiment of the method or methods outlined above, the method may further comprise a step of:

adding one or more hollow portions to the prill to control the density of the asphaltene prill.

In yet another embodiment of the method or methods outlined above, the one or more hollow portions may be added to the inner core of the asphaltene prill.

In yet another embodiment of the method or methods outlined above, one or more additional diluents may be added to the slurry.

In another embodiment of the method or methods outlined above, the method may further comprise a step of:

DETAILED DESCRIPTION

Described herein are methods for preparing, converting, and/or transporting bitumen. Asphaltene prills, converted bitumen that is suitable for transport, and prilling processes are also disclosed. It will be appreciated that the methods, systems, apparatuses, techniques, uses and embodiments described herein are for illustrative purposes intended for those skilled in the art and are not meant to be limiting in any way. All reference to embodiments or examples throughout this disclosure should be considered a reference to an illustrative and non-limiting embodiment or an illustrative and non-limiting example.

Figure 1:
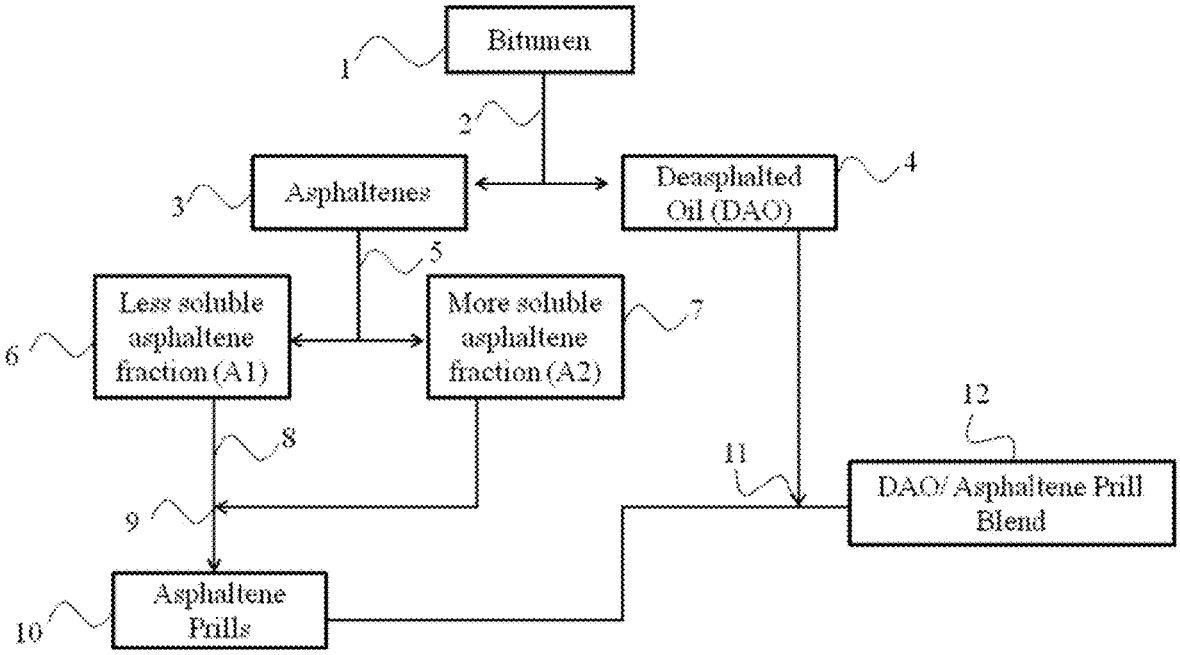
FIG. 1 shows a flow chart illustrating steps of one non-limiting example illustrative of a method for preparing bitumen for transport. The illustrative method comprises the steps of: separating asphaltenes (also referred to as asphaltene) from the bitumen to generate a deasphalted oil (DAO) and asphaltenes; separating the asphaltenes into a first asphaltene fraction and a second asphaltene fraction, the first asphaltene fraction being less soluble in deasphalted oil and the second asphaltene fraction being more soluble in deasphalted oil; forming an asphaltene prill comprising an inner core comprising the second asphaltene fraction and an outer layer comprising the first asphaltene fraction; and combining the DAO and asphaltene prills to form a blend suitable for transport (i.e. via a pipeline)

One embodiment of a method for preparing bitumen for transport is shown in the flow chart of FIG. 1, wherein bitumen (1) may be separated by a separation process (2) into asphaltenes (3) and deasphalted oil (DAO) (4). The asphaltenes (3) may then be separated into two fractions: a first fraction which is less soluble in DAO (6), and a second fraction which is more soluble in DAO (7) using a suitable separation process (5). Asphaltene prills (10) comprising an inner core comprising the second fraction and an outer layer comprising the first fraction may be generated using a suitable prilling process (i.e. a combination of (8) and (9) in FIG. 1). The asphaltene prills (10) may be combined with the DAO (4), which has optionally been visbroken, to form a blend or slurry (12) having suitable characteristics for transport in a pipeline (i.e. having flowability and density characteristics compatible with pipeline transport).

Bitumen extracted from oil sands in Alberta may contain approximately 16% wt asphaltenes and may be processed to remove water and sediment to suit a desired BS&W range, however, such processed bitumen may still have a lower API gravity of, for example 17 API, and a higher viscosity of 8250 cS. In some embodiments, the blend or slurry disclosed herein may have an API gravity of 19 or greater, and/or a viscosity of 380 cS or less, which may be specified as a maximum density specification of 920 $kg/m^3$.

It will be appreciated that generally, bitumen (1) may be separated into asphaltenes (3) and deasphalted oil (DAO) (4) using any suitable technique or process (2) known to those of skill in the art. By way of example, the separation of bitumen into asphaltenes and DAO may be accomplished using a de-asphalter unit. As will be known to the person of skill in the art, the de-asphalter unit may be, for example, a solvent de-asphalter (SDA) unit or a deep cut SDA, and may optionally be associated with a vacuum distillation tower. Any suitable solvent may be used in the SDA, such as propane, butane, or pentane.

It will also be appreciated that asphaltenes (3) may be separated into a first A1 asphaltene fraction (6) which is less soluble in DAO, and a second A2 asphaltene fraction (7) which is more soluble in DAO. As will be recognized by the person of skill in the art, the A1 asphaltene fraction (6) may include less soluble or "continental" asphaltenes. The term "continental" will be understood by those of skill in the art to indicate or include asphaltenes with, e.g., fused cyclic structures and few branches. These A1 asphaltenes may tend not to dissolve even in toluene, partly because they agglomerate/form an emulsion. The A2 asphaltene fraction (7) may include more soluble or "archipelago" asphaltenes. The term "archipelago" will be understood by those of skill in the art to indicate asphaltenes that are easier to break down as compared to "continental" compounds, and having, e.g., fewer fused rings, and more branches.

Any suitable technique or process (5) known to those of skill in the art may be used to separate the first asphaltene fraction (6) and the second asphaltene fraction (7). By way of an illustrative example, p-nitrophenol or other known chemical methods can be used to separate the A1 (6) asphaltenes from the A2 (7) asphaltenes. One illustrative example may be related to the technique described in [Gutierrez L B et al., Fractionation of asphaltene by complex formation with p-nitrophenol. A method for structural studies and stability of asphaltene colloids. *Energy Fuels* 2001; 15(3):624-8] herein incorporated by reference in its entirety.

In some embodiments, if a diluent is added to the bitumen, the A1 asphaltene fraction, or the A2 asphaltene fraction prior to prilling, then at least a portion of the diluent may be removed or recycled prior to prilling.

The asphaltene prills (10) may be formed using the asphaltene fractions (6) and (7) using any suitable prilling or pelletizing process known to those of skill in the art. By way of example, a prilling process may involve a process (8) of spraying, atomizing, dripping, or otherwise introducing the second asphaltene fraction (A2) (7) into a prilling vessel, thereby forming droplets of the asphaltene A2 fraction (7) at the top of the prilling vessel. In some embodiments, the droplets may have diameters in the nanometer range. In still other embodiments, the droplets may have a diameter of between 100 nanometers to 100 microns. It will be understood to those of skill in the art that the asphaltene A2 fraction may be introduced into the prilling vessel as a liquid, as a solid which is heated to form a liquid, or in any other manner know in the art which allows for the production of suitable droplets, spheres, or pellets. In various embodiments, the A2 droplets may, at least partially, solidify while in free fall or moving through the prilling vessel, and a countercurrent gas flow may be used to promote this solidification. In an associated process (9), the exterior of the droplets (which may be at least partially solidified) may be sprayed or otherwise coated with the less-soluble asphaltenes fraction (A1) (6), forming asphaltene prills (10) comprising an inner core comprising the second fraction (7) and an outer layer comprising the first fraction (6). The spraying may be carried out while the droplets are moving through the prilling vessel. Suitable prilling, microprilling, and/or pelletizing processes will be readily known to those of skill in the art, as will suitable techniques amenable for coating the A2 fraction droplets/prills with the A1 fraction. An example of an embodiment of a suitable prilling process is provided in more detail below.

The resulting asphaltene prills (10) include an inner core (22) comprising the more soluble asphaltene A2 fraction (7) and an outer layer (21) comprising the less soluble asphaltene A1 fraction (6). As the asphaltene prills (10) include an outer layer (21) that is at least partially inert, insoluble and/or stable in DAO, the prills (10) can be suspended in DAO and remain substantially intact, at least over a certain period. In one embodiment the prills (10) can be suspended in DAO and remain partially or substantially intact for about one month. In another embodiment, the prills (10) may remain partially or substantially intact for about 6 months. It will be understood that the duration for which the prills (10) may remain substantially, or at least partially, intact in DAO may be readily adjusted as desired by, for example, increasing the outer layer (21) thickness, applying multiple A1 fraction outer layers, or adjusting the composition of the outer layer to increase the insolubility of the outer layer in DAO. The duration for which it may be desirable for the asphaltene prills to remain at least partially intact in DAO may depend on the distance to be transported and the duration of time the asphaltene prills will remain in the DAO. The person of skill in the art will recognize that, for example, transport for a brief period of time over a short distance will allow for the use of a less DAO-inert asphaltene prill, whereas transport over an extended distance and time period may benefit from an asphaltene prill with comparatively increased stability in DAO.

A1 asphaltenes typically make up approximately 10 to 25% w/w of the total asphaltenes in Athabasca oil. Bitumen extracted from oil sands in Alberta may contain approximately 16% wt asphaltenes. In some embodiments, the outer layer portion of the asphaltene prills (vs. the inner core) may represent close to the naturally occurring fraction, i.e., in some embodiments, the outer layer may represent 10 to 25% of the total asphaltene prill mass.

In an embodiment, the weight fraction of the DAO and the asphaltene prills may be close to the naturally occurring ratio of DAO to asphaltenes, which typically for Athabasca oil is in the range of 75 to 90 w % DAO.

In another illustrative embodiment, the asphaltene prills (10) may feature an outer layer (21) further comprising one or more additional components to enhance or prolong the stability of the prills (10) in a slurry or blend with DAO. Such additional components may include any suitable coating which is at least partially inert towards DAO. Additional components may include lighter parrafinic wax or plastics.

In one embodiment, the asphaltene prills may comprise multiple layers of A1 asphaltene, which may provide prills with increased stability in DAO. In another embodiment, the asphaltene prills may comprise multiple asphaltene layers of differing solubility, for example the prills may comprise A1-A2-A1-A2 layers wherein the latter A2 layer is interior to the asphaltene prill, and the former A1 layer is on the exterior of the asphaltene prill. Such an asphaltene prill could be produced, in an embodiment, by coating an asphaltene prill comprising an inner core and an outer layer as discussed above with a further A2 layer, and then a further A1 layer.

In another illustrative embodiment, the asphaltene prills (10) may have a diameter in the nanometer range, and should not settle out of suspension easily when slurried with DAO. For the purposes of pipeline transport, agitation/disturbances in the DAO/asphaltene prill slurry or blend as it is transported through the pipeline (23) can help to prevent particle settling. Calculations shown in Table 1 indicate that settling velocity for these prill diameters falls within an appropriate range.

TABLE 1

Radius and associated settling velocity. (Approximate linear velocity ~1.4 m/s in a 3' line carrying 0.5 MMbbl/d crude blend)

| Radius (μm) | Settling Velocity (m/s) |
|---|---|
| 0.1 | 1.27e−12 |
| 1 | 1.27e−10 |
| 10 | 1.27e−8 |
| 100 | 1.27e−6 |
| 1000 | 1.27e−4 |

As will be discussed in more detail below, in various embodiments the asphaltene prills (10) will have a size/density which is suitable to reduce or prevent settling within the pipeline during transport. The skilled person will recognize that appropriate size/density values will depend on a number of factors, including flow rate in the pipeline. In some examples, the prills (10) will remain in the slurry/blend with the DAO, without substantial settling or dissolution, for a duration that is sufficient to allow for at least partial transport to, for example, a refinery, a processing site or to a further prilling location, at least partially via a pipeline.

As further detailed below, in some embodiments the density of the prills (10) may be adjusted during the prilling process by producing prills (10) which comprise at least one hollow portion. Prills (10) can thus be generated with gravity neutral density characteristics (i.e. the prills (10) may have a density that is similar to or the same as the density of the DAO). In this manner, the resulting DAO/asphaltene prill blend or slurry may be prepared so as to comply with pipeline density specifications as will be known to those of skill in the art.

In certain embodiments, asphaltene prills (10) comprising one or more hollow portions may be prepared using any suitable prilling method known to those of skill in the art. By way of example, asphaltene prills comprising one or more hollow portions may be prepared by introducing a gas (i.e. air, $N_2$, $CO_2$, $H_2O$, $CH_4$, any suitable non-condensable gas or gases, a combination thereof, or any other suitable gas or gases known in the art), which may form micro and/or nanobubbles, into the prilling vessel when producing the asphaltene prills (10) such that one or more hollow portions are incorporated into the prills. In this manner, the density of the inner core of the prills can be adjusted by controlling the hollow portion component of the asphaltene prills. By way of example, the asphaltene prill density may be adjusted in this manner so as to produce asphaltene prills with a density that is substantially similar to that of DAO.

In various embodiments, the one or more hollow portions of the asphaltene prills may be introduced into the inner core of the asphaltene prills, rather than the outer layer. In this manner, the overall asphaltene prill density can be adjusted, while maintaining a uniform and uninterrupted outer layer that entirely encompasses the inner core of the asphaltene prills.

The person of skill in the art will recognize that, in some instances, increasing the surface area of the outer layer of the asphaltene prills (10), or interrupting the outer layer covering, through the introduction of hollow portions (for example, bubbles or air/gas pockets) in the outer layer may increase the susceptibility of the asphaltene prills to degradation in DAO. As such, in various embodiments the hollow portions may be introduced to the inner core rather than to the outer layer of the asphaltene prills. It will be appreciated, however, that it is within the scope of the invention that the outer layer may include some hollow portions introduced during the process of adjusting the density of the inner core, through, for example, gas introduction.

In a further embodiment, the deasphalted oil (4) shown in FIG. 1 may optionally be visbroken to lower the viscosity of the DAO. The person of skill in the art will recognize that any suitable visbreaking method may be used, for example a visbreaker processing unit may be used to thermally crack the DAO, producing a visbroken DAO with lower viscosity and, optionally, a reduced TAN (total acid number).

In some embodiments, the density of either or both the DAO and the asphaltene prills can be reduced. DAO density may be reduced by thermal cracking, and prill density may be reduced by incorporating one or more hollow portions.

As indicated in the embodiment illustrated in FIG. 1, the DAO (which has optionally been visbroken) can be combined with the asphaltene prills (10) in process (11) to produce a DAO/asphaltene prill blend or slurry (12). The blend or slurry (12) may have a viscosity that is reduced compared to that of the starting bitumen (1), and may be readily transported via a pipeline. In some embodiments, the ratio of DAO to asphaltene prills, or the ratio of visbroken DAO to non-visbroken DAO, can be adjusted to achieve viscosity and flowability properties amenable to pipeline transportation.

In some embodiments, the DAO/asphaltene prill blend or slurry (12) may be a homogeneous slurry of DAO (4) and asphaltene prills (10).

Although the slurry or blend (12) has been described as a slurry or blend of asphaltene prills (10) in DAO (4), the person of skill in the art will recognize that the DAO (4) may be partially or fully substituted or combined with bitumen, visbroken bitumen, deasphalted bitumen, or some other suitable upgraded or partially upgraded bitumen or mixture thereof as will be known to the person of skill in the art. Such a combination and/or substitution is within the scope of the invention.

In various embodiments, an amount of one or more additional diluents may be added to the slurry or blend (12). The additional diluent may be used to further reduce the viscosity of the slurry (12), or to adjust the density, flowability, or other relevant parameters or characteristics of the slurry (12). In various embodiments, the amount of additional diluent added to the slurry (12) may be less than the amount of additional diluent that is typically added to recovered bitumen to be directly transported by pipeline using traditional methods.

In some embodiments, an amount of additive or diluent may be added/mixed with the slurry or blend. The amount may depend on the desired transportation specification suitable for transport, the initial characteristics of the slurry or blend, and the characteristics of the additive or diluent mixed with the slurry or blend. A diluent used may have varying characteristics. In some embodiments, the diluent may have a higher API gravity and a lower viscosity than the desired transportation specifications such that the desired transportation specifications may be met when mixed with the slurry or blend.

In an embodiment, the diluent may comprise natural gas condensate with an API gravity of approximately 75 and a viscosity of 0.45 cS. It will be appreciated that the amount of diluent to be mixed may depend upon the characteristics of the diluent used. In some embodiments, less than 50% vol may be used to dilute the slurry or blend. In further embodiments, less than 20% vol may be used. It will be appreciated that the measurements of the characteristics are given for a reference temperature, which may differ from the actual temperature of the slurry or blend, and that desired transportation specifications may change throughout the year.

In an embodiment, the diluent may include, for example, oil sands condensate, a synthetic hydrocarbon blend, naphtha, butane, or any combination thereof.

In a further embodiment, additional diluent added to the slurry (12) may optionally be removed and/or recycled following transport of the slurry (12) to a refinery or other processing or storage facility. In one example, a diluent recovery unit (DRU) may be used to recover added diluent(s).

Figure 2:
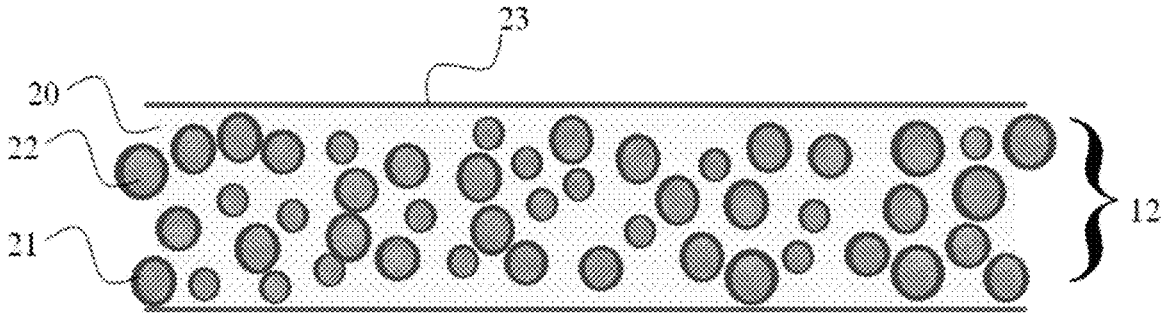
FIG. 2 is a schematic illustrative of one non-limiting embodiment of bitumen being transported via a pipeline. The illustrative embodiment shows deasphalted oil and asphaltene prills comprising an outer DAO-insoluble asphaltene layer (A1) and an inner DAO-soluble asphaltene core (A2) being transported in a pipeline as a DAO/asphaltene prill blend or slurry.

As shown in the embodiment illustrated in FIG. 2, the slurry (12) may be transported via a pipeline (23). Within the pipeline, the slurry (12) may comprise DAO (20), and asphaltene prills having a DAO-soluble inner core (22) and a DAO-insoluble or inert outer layer (21). It will be understood that a range of solubilities in DAO are possible for the DAO-soluble inner core (22) and for the DAO-insoluble or inert outer layer (21). The DAO-soluble inner core (22) may, in some cases, be readily soluble in DAO, or it may have a solubility in DAO which is only slightly better than that of the inert outer layer (21), or even nearly the same as the inert outer layer. The DAO-insoluble or inert outer layer may, in some cases, be entirely or substantially insoluble in DAO under typical pipeline conditions, or it may have partial solubility in DAO, or even high solubility in DAO over an extended period of time. By way of example, in some cases where the asphaltene prills are exposed to DAO for only a short period of time during transport, it may be possible to have an outer layer which would eventually dissolve in DAO, but not substantially so during a short duration of time.

The density of the asphaltene prills may be within a range which prevents or reduces settling of the prills out of the slurry or blend which is being transported within the pipeline (23).

As used herein, the term "pipeline" includes any suitable infrastructure for the transport of substances through one or more pipes. Without intending to be limiting, the term pipeline may refer to a structure comprising one or more pipes extending from a site of bitumen recovery, processing, and/or storage to a site of bitumen processing, storage, a refinery or a further prilling site.

The person of skill in the art will recognize that transportation infrastructure and operations, including for example, pipelines, pump stations, and management of infrastructure upset conditions, may be tailored to facilitate the flow of a slurry and the stability of the prills in a slurry, for example, by selecting infrastructure materials or coating piping and pumps with a sacrificial or wear-resistant material.

Upon arrival of the slurry (12) at the refinery or processing facility, the asphaltene prills may be removed from the slurry (12) using any suitable process known in the art to produce DAO that is substantially free of asphaltenes, and separately, asphaltene prills or asphaltenes. By way of example, the asphaltene prills (10) may be removed from slurry (12) using a filter separation. In some embodiments, the resulting DAO may be directly fed to a cracking unit at the refinery.

Although FIG. 2 illustrates the transport of slurry (12) in a pipeline (23), it should be recognized that the slurry (12) comprising DAO (4) and asphaltene prills (10) may also, in other embodiments, be transported using other methods known in the art. For example, the slurry (12) may also be transported by rail, motor vehicle such as a truck, and/or ship. As detailed above, the asphaltene prills (10) may be readily removed from slurry (12) upon arrival at the refinery or processing facility to obtain DAO that is substantially free of asphaltene, and separately, asphaltenes. Depending on market considerations, one form of transportation may be more or less expensive at any given time. A form of bitumen which can be easily separated into DAO and asphaltenes is still of interest if it is transported via traditional modes of transportation.

It will be appreciated that the term "flowability" as used herein relates at least to the slurries disclosed herein and is intended to refer to and/or encompass an equivalent viscosity of a liquid or liquid mixture having no solid particles, including prills, through the same or similar conduit, such as a pipeline, at a given operating condition and can be used to denote a viscosity equivalent parameter for the slurry.

The following examples and embodiments are provided for illustrative purposes only, and are intended to demonstrate certain non-limiting embodiments. The examples below are not intended to limit the scope of the invention disclosed herein in any way and are not intended to be limiting in any way.

Example 1: Prilling Process

Figure 3:
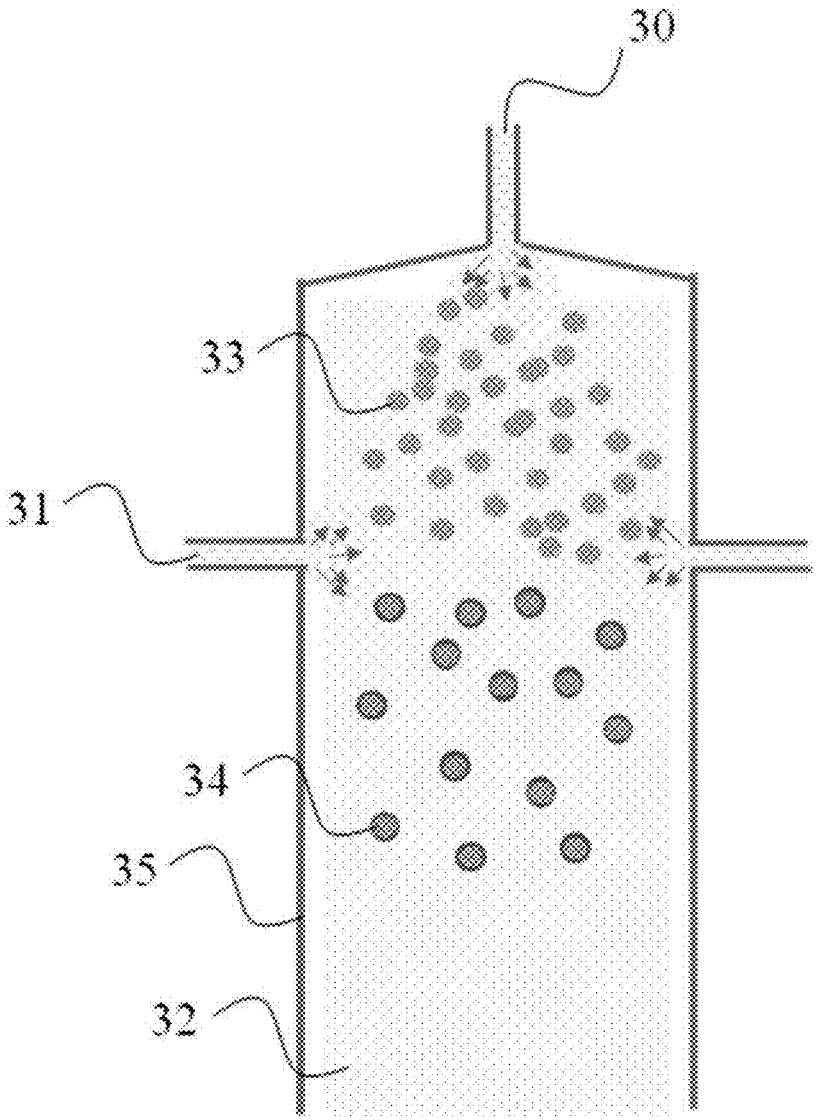
FIG. 3 shows an illustrative non-limiting embodiment of a prilling vessel and a prilling process being carried out therewith for producing asphaltene prills. The illustrative embodiment shows DAO-soluble asphaltene (A2) being introduced into the prilling vessel, where it forms droplets which are then coated with DAO-insoluble asphaltene (A1) to form asphaltene prills comprising an outer DAO-insoluble asphaltene layer (A1) and an inner DAO-soluble asphaltene core (A2)

As detailed above, the asphaltene prills (10) may be produced using any suitable prilling or pelletizing process known to those of skill in the art. An example of a prilling process for forming asphaltene prills (34) is illustrated in FIG. 3. The asphaltene prills (34) may be formed using a micro-prilling process in a prilling vessel such as a prilling tower (35). In this example, the A2 asphaltene fraction (30) (i.e. the more soluble asphaltene fraction) is directed through one or more inlets into the upper portion of the prilling tower at a temperature of approximately 200° C. and at a pressure/other conditions which ensure that the A2 asphaltene fraction (30) is in liquid form when it enters the tower. The A2 fraction (30) is sprayed, atomized, dripped, or otherwise introduced into the tower such that it forms droplets which fall towards the bottom of the prilling tower.

The exemplified prilling process utilizes a vapor carrier (32) (i.e. $CH_4$) to cool the prills and optimize prilling conditions within the prilling tower such that the falling droplets form substantially solid or fully solid particles (33) comprising the more soluble A2 asphaltene fraction (30).

The prilling tower (35) further includes one or more inlets for introducing the less soluble A1 asphaltene fraction (31) in liquid form into the prilling tower. The A1 fraction (31) is sprayed or otherwise coated/applied onto the exterior of the A2 prills (33), forming an outer layer of the A1 fraction (31) on the A2 prills (33), resulting in the final asphaltene prills (34) which comprise an inner core comprising A2 asphaltenes and an outer layer comprising A1 asphaltenes. If necessary or desired, multiple passes of the A2 prills (33) may be performed to generate an outer layer of A1 asphaltene of sufficient thickness to prevent significant re-dissolution of the asphaltenes when slurried with DAO. Optionally, an additional coating as described above may be added before, simultaneously with, or after the A1 outer layer is added to the A2 prills (33).

Example 2: Prilling Process with Density Adjustment

Figure 4:
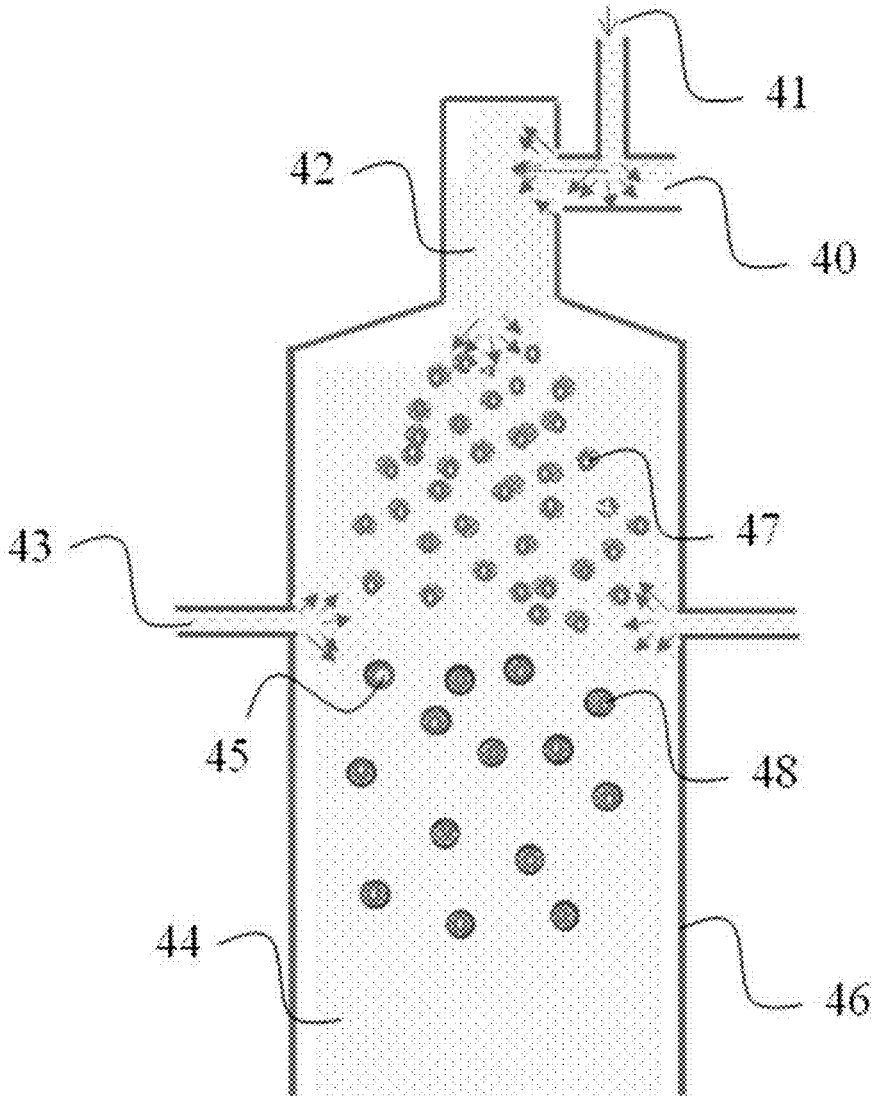
FIG. 4 shows another illustrative non-limiting embodiment of a prilling vessel and a prilling process being carried out therewith for producing asphaltene prills. The illustrative embodiment shows DAO-soluble asphaltene (A2) being introduced into the prilling vessel along with a gas (i.e. air, $N_2$, $CO_2$, $H_2O$, etc. . . . ), forming droplets with one or more hollow portions (for example, micro/nanobubbles), which are then coated with DAO-insoluble asphaltene (A1) to form asphaltene prills comprising an outer DAO-insoluble asphaltene layer (A1), an inner DAO-soluble asphaltene core (A2), and a hollow portion. In the illustrative embodiment, the one or more hollow portions are within the inner core of the asphaltene prills.

Another example of a prilling process for forming asphaltene prills is illustrated in FIG. 4. Here, as in FIG. 3, the asphaltene prills (48) may be formed using a micro-prilling process in a prilling tower (46). In this example, the A2 asphaltene fraction (40) (i.e. the more soluble asphaltene fraction) is directed through one or more inlets into the upper portion of the prilling tower at a temperature of approximately 200° C. and at a pressure/other conditions which ensure that the A2 asphaltene fraction (40) is in liquid form when it enters the tower. The A2 fraction (40) is sprayed, atomized, dripped, or otherwise introduced into the tower such that it forms droplets or spheres which fall towards the bottom of the prilling tower. In the example shown in FIG. 4, the A2 fraction (40) is introduced into the prilling tower (46) along with a gas (41) (i.e. air, $N_2$, $CO_2$, $H_2O$, $CH_4$, etc. . . . ), which forms micro and/or nanobubbles (42), such that the A2 asphaltene prills (47) contain one or more hollow portions. In this manner, the density of the inner core of the prills can be adjusted by controlling the contribution of the hollow portion component to the inner core of the prills.

The exemplified prilling process may utilize a vapor carrier (44) (i.e. $CH_4$) to cool the prills and optimize prilling conditions within the prilling tower such that the falling droplets form substantially or fully solidified particles (47) comprising the more soluble A2 asphaltene fraction (40).

The prilling tower further includes one or more inlets for introducing the less soluble A1 asphaltene fraction (43) in liquid form into the prilling tower. The A1 fraction (43) is sprayed, coated, or otherwise applied onto the exterior of the falling A2 prills/droplets (47), forming an outer layer of the A1 fraction (43) on the exterior of the A2 prills (47), resulting in the final asphaltene prills (48) which comprise an inner core comprising A2 asphaltenes, an outer layer comprising A1 asphaltenes, and one or more hollow portions (45) in the inner core. If necessary or desired, multiple passes of the A2 prills (47) may be performed to generate an outer layer of A1 asphaltene of sufficient thickness to prevent significant re-dissolution of the asphaltenes when slurried with DAO. Optionally, an additional coating as described above may be added before, simultaneously with, or after the A1 outer layer is added.

It will be appreciated that various modifications, changes, adaptations and substitutions may be made to the embodiments disclosed and claimed herein without departing from the scope and spirit of the invention and such modifications, changes, adaptations and substitutions are intended to be captured by the scope and spirit of the disclosure and claims. The disclosure provides embodiments for the purposes of illustrating the invention and are not intended to limit the scope of the claims.

What is claimed is:

1. A converted bitumen comprising:

asphaltene prills, the asphaltene prills comprising an asphaltene inner core comprising an asphaltene fraction that is more soluble in deasphalted oil and an asphaltene outer layer comprising an asphaltene fraction that is less soluble in deasphalted oil; and deasphalted oil.

2. The converted bitumen of claim 1, wherein the deasphalted oil is visbroken deasphalted oil.

3. The converted bitumen of claim 1, wherein the asphaltene prills further comprise at least one hollow portion.

4. The converted bitumen of claim 3, wherein the at least one hollow portion is in the inner core of the asphaltene prills.

5. The converted bitumen of claim 1, wherein the converted bitumen further comprises one or more additional diluents.

6. An asphaltene prill comprising:

an inner core, the inner core comprising an asphaltene fraction having a first solubility in deasphalted oil; and an outer layer, the outer layer comprising an asphaltene fraction having a second solubility in deasphalted oil;

wherein the second solubility is less than the first solubility.

7. The asphaltene prill of claim 6, further comprising at least one hollow portion.

8. The asphaltene prill of claim 7, wherein the at least one hollow portion is in the inner core of the asphaltene prill.

* * * * *